United States Patent [19]

Lemley et al.

[11] 3,978,791

[45] Sept. 7, 1976

[54] SECONDARY EXPLOSIVE DETONATOR DEVICE

[75] Inventors: Virgil F. Lemley, Escondido; Glenn E. Seay, La Jolla; Perry B. Ritter, Encinitas, all of Calif.

[73] Assignee: Systems, Science and Software, La Jolla, Calif.

[22] Filed: Sept. 16, 1974

[21] Appl. No.: 506,119

[52] U.S. Cl. ..... 102/28 R; 89/1 B

[51] Int. Cl.[2] ..... F42B 3/12; F42C 19/12

[58] Field of Search ..... 102/28; 89/1 C, 1 B

[56] References Cited

UNITED STATES PATENTS

| | | | |
|---|---|---|---|
| 2,883,931 | 4/1959 | Houck et al. | 89/1 C |
| 3,062,143 | 11/1962 | Savitt et al. | 102/28 |
| 3,158,097 | 11/1964 | Brockway et al. | 102/28 |

*Primary Examiner*—Verlin R. Pendegrass
*Attorney, Agent, or Firm*—Fitch, Even, Tabin & Luedeka

[57] ABSTRACT

A reliable low voltage, electrically actuated, all secondary explosive detonator device is disclosed which is thermally and chemically stable and is relatively insensitive to shock and electrostatic charge. The device includes a cylindrical body having a chamber containing a donor secondary explosive, an elongated bore extending from the donor explosive to an acceptor secondary explosive, with a generally flat annular shoulder located at the junction of the bore and the chamber, an impactor disc positioned within the chamber against the shoulder and blocking the bore and low voltage electrical deflagration initiating means positioned within the chamber and extending outwardly of the body. Application of low voltage current to the conductors initiates deflagration of the donor explosive so that the central portion of the impactor disc is sheared and accelerated through the bore striking the acceptor explosive with sufficient velocity to detonate the acceptor explosive.

14 Claims, 3 Drawing Figures

SECONDARY EXPLOSIVE DETONATOR DEVICE

The invention described herein was made under a contract with the Air Force Armament Laboratory, Air Force Systems Command, U.S. Air Force, Eglin Air Force Base, Florida.

This invention generally relates to improved detonator devices, and more particularly to detonator devices that contain only secondary explosives and are therefore less hazardous because of their reduced sensitivity to shock, electrostatic charge, heat and the like.

In addition to the typical use of detonator devices of effecting the explosion of main charges in high explosive work, other commercial applications for detonator devices may include actuation of protective air bags for motor vehicles or the like. In addition to the extremely high reliability of operation that would be required for operating such protective air bags, the safety of such devices in terms of untimely detonation must be extraordinary because of the potential extensive exposure to human life. Of course, increased safety and reliability in detonating high explosives is a matter of continuing concern by both the civilian and military sectors.

Research programs having an objective to develop low-voltage detonators containing no primary explosives have been carried out for some time. Previously, detonators normally consisted of spark or heat sensitive primary explosives and a booster charge, typically a secondary explosive, which provided the main impulse of the detonator. The primary explosive is usually lead azide, lead styphnate or mercury fulminate. The sensitivity of such primary initiating explosives to shock, spark, and impact necessarily introduces hazards in manufacture and use requiring elaborate precautions to insure safety during handling. Mercury fulminate is well known as being thermally unstable and has been generally replaced by lead azide. However, lead azide is susceptible to hydrolysis which, in the presence of copper, results in the formation of sensitive corrosion products. Therefore, unless they are stored under proper conditions, detonators containing mercury fulminate or lead azide have a limited shelf life. While lead styphnate is chemically more stable, it presents serious hazards due to its sensitivity to electrostatic charge conditions which are known to exist in some types of electric detonators. Additionally, primary explosives tend to detonate rather than burn, and friction and fire can lead to detonation in adjoining secondary explosives. The high sensitivity or primary explosives dictates separate handling and storing of the detonators from high explosives.

For these many reasons, it is highly desirable to eliminate the use of primary explosives in detonating devices, using instead the secondary explosives which exhibit significantly reduced mechanical sensitivity, good chemical stability and little hazard due to electrostatic charge sensitivity. Thus, the use of secondary explosives to the exclusion of primary explosives in detonators reduces the hazards of handling detonators to approximately the same level that exists in handling main charges.

While all secondary explosive low voltage detonators have presumably been designed to take advantage of the lesser hazards that are offered, the designs heretofore used have exhibited operational reliability that is suspect.

Accordingly, it is an object of the present invention to provide an improved detonator device that contains only secondary explosives and therefore has the inherent advantages in terms of the potential hazards, but which exhibits extremely high reliability during use.

Another object of the present invention is to provide a detonating device that contains only secondary explosives and which can be utilized for uses other than with high explosives, such as actuating high pressure containers that drive protective air bags within motor vehicles and the like.

Other objects and advantages will become apparent upon reading the following detailed description, in conjunction with the attached drawings, in which.

Broadly stated and referring generally to the drawings, the detonator device indicated generally at 10 utilizes hot wire initiation of a self-sustaining deflagration in a donor secondary explosive to cause release and acceleration of a portion of a disc so that it strikes an acceptor secondary explosive with sufficient velocity that its impact produces detonation of the acceptor secondary explosive.

Figure 1:
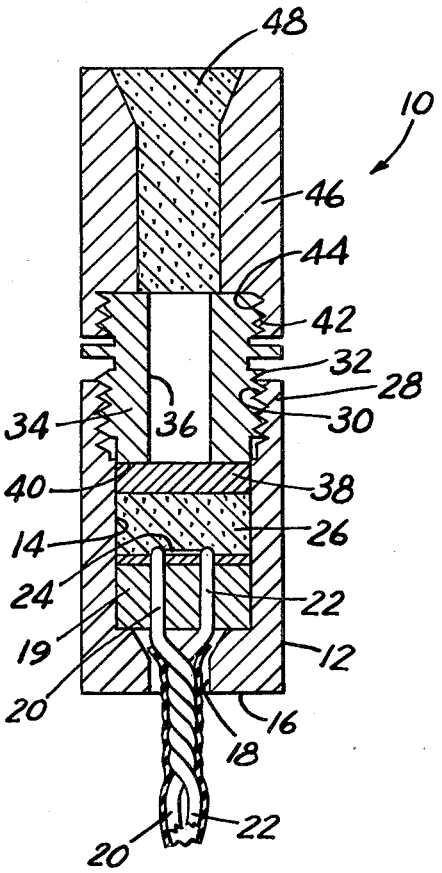
FIG. 1 is a cross-section of a detonator device embodying the present invention.

More specifically, the detonator device illustrated in FIG. 1 includes a generally cylindrically shaped body 12 having a chamber or bore 14 formed therein for containing other components of the device, the body 12 having a substantially closed end portion 16 with a small opening or aperture 18 therein. A header 19 is positioned within the chamber 14 in abutting relation to the end wall 16 of the body and also contains apertures through which electrical conductors 20 and 22 may pass. The conductors 20, 22 comprise initiation leads which are externally connected to a power source (not shown) for supplying a low voltage current to the device. The conductors terminate within the chambers 14 and have a small diameter bridge wire 24 connected thereto, which is preferably made of platinum or other suitable material and has a diameter of approximately 15 ten thousandths of an inch with a resistance within the range of about 0.33 to about 0.45 ohms. The bridge wire 24 is heated to a temperature sufficient to initiate deflagration of a donor secondary explosive 26 located within the chamber, in response to low voltage electrical current being applied to the conductors 20, 22 from the source. The current applied to the conductors is preferably within the range of about 1 to about 10 amperes, with larger currents shortening the time required to actuate the device.

An end portion 28 of the body 12 located oppositely of the closed end 16 is provided with interior threads 30 for engagement with threads 32 located on a barrel portion 34. The barrel 34 has an elongated cylindrically shaped bore 36 extending the full length thereof through which the central portion of a flyer or impactor disc 38 may travel. The end of the barrel adjacent the chamber 14 defines a generally flat annular shoulder 40 upon which the impactor disc 38 abuts. As shown, the impactor disc is positioned between the shoulder 40 and the donor secondary explosive 26 and covers the bore 36 of the barrel portion 34. It should be understood from the drawing that the header 19, the secondary donor explosive 26 and the impactor disc 38 all have a diameter approximating the inside diameter of the chamber 14 so that as the barrel 34 is rotated in the direction to urge the impactor disc toward the closed end 16 of the body, the shoulder 40 of the barrel will compress the components together into intimate contact and tightly confine the donor explosive 26.

The impactor disc 38 defines a seal for the highly compressed donor explosive which may be important depending upon the kind of explosive that is used, inasmuch as certain of the secondary explosives must be strongly confined to obtain ignition using the hot wire process and to sustain complete deflagration once ignition occurs. It is also important that the outer diameter of the impactor disc be substantially the same as the inside diameter of the chamber 14 so that pressure created during deflagration of the donor explosive cannot escape between the disc and the chamber wall.

At the upper end of the barrel, exterior threads 42 are formed for receiving a cooperating internally threaded portion 44 of an acceptor explosive housing 46 containing an acceptor secondary explosive 48 which provides the main charge of the device.

Figure 2:
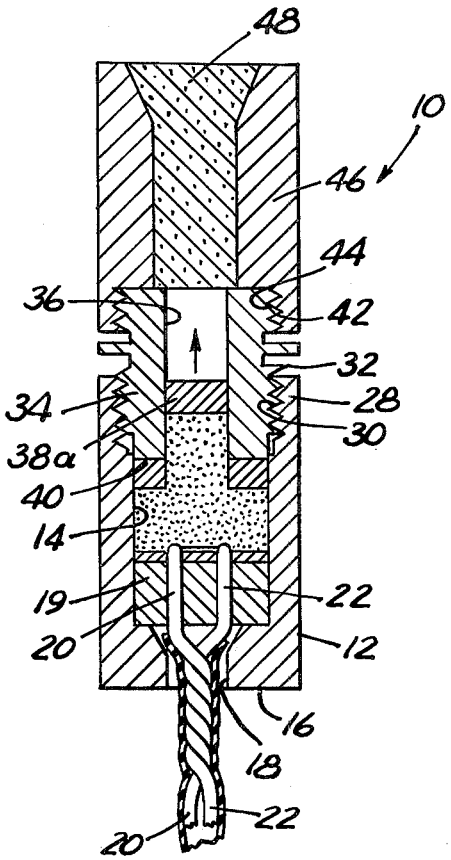
FIG. 2 is a cross-section of the detonator shown in FIG. 1 and is shown during actuation.
Figure 3:
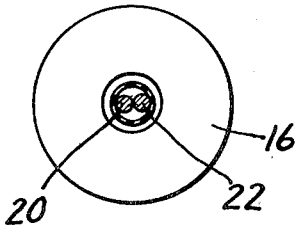
FIG. 3 is an end view of the device.

Broadly stated, the deflagration of the donor explosive 26 causes the central portion, identified as the portion 38*a* in FIG. 2 which is the portion located radially inwardly of the annular shoulder 40 of the barrel, to be sheared or punched therefrom and be accelerted down the bore 36 toward the acceptor secondary explosive 48 with sufficient velocity and force to initiate detonation when it strikes the acceptor explosive.

In keeping with the present invention, the types of secondary explosives that may be used for the donor explosive 26 include RDX, PETN, HMX and others which will sustain a deflagration in the approximate configuration with or without strong confinement. However, the explosive that is preferred is a RDX explosive, type B, class C, military standard MIL-R-398C having a particle size of about 100 microns, and pressed to 12,500 psi pressure to achieve a density of about 1.65 to about 1.67 and preferably about 1.65 grams/cc. Its chemical composition is 1, 3, 5 - trinitro - 1, 3, 5 - triazacyclohexane and is made by the acetic anhydride process. An important consideration in the determination of the type of donor explosive to be used is that it be self-sustaining after initial ignition and undergo complete deflagration to provide sufficient pressure to shear or punch out the central portion 38*a* of the impactor disc.

As will be subsequently explained in more detail, the pressure required to achieve the shearing of the central portion 38*a* from the impactor disc is a function of the physical characteristics of the material from which the impactor disc is made, as well as the physical dimensions of the disc. With the material composition and physical characteristics contemplated for the impactor disc 38, a pressure of about 50,000 psi generated within the chamber 14 by the deflagration of the donor secondary explosive is sufficient to shear the central portion of the impactor disc and accelerate it through the bore 36 at sufficient velocity to impact the acceptor secondary explosive 48 and cause its detonation.

With respect to the composition of the acceptor secondary explosive, those types of explosives listed in military standard MIL-STD-1316 may be used. However, a PBNX-5 explosive, made in accordance with military standard MIL-E-8111, and having a particle size of 20 microns per military standard RR-S-366, when pressed to a density of about 1.67 g/cc is preferred. The chemical composition of pbxn-5 is copolymer, having about 4.5% to about 5.5% by weight vinylidene fluoride and hexafluoro-propylene, with the remainder being HMX which is 1, 3, 5, 7 - tetranitro - 1, 3, 5, 7 - tetrazacyclo - octane.

The detonation of the acceptor secondary explosive produced by the impact or shock of the central portion 38*a* of the impactor disc is a function of the interaction pressure between the explosive and the central portion 38*a* of the impactor disc. Pressure, however, is but one parameter that produces a high order detonation of an explosive. The time that the pressure acts in addition to the distance the pressure wave travels into the explosive, are also important parameters. Thus, if the area of impact is quite small, as would occur in the event the central portion of the impactor disc disintegrated into a number of small fragments for example, release waves would move in to relieve the high pressure and would shorten or limit the time in which the initial pressure is applied. If the time in which the pressure is applied is of insufficient duration, detonation may not be achieved. Each type of explosive has its own limit of combined pressure and initiation distance that are required to achieve a high order detonation and these limits are determined by the chemical composition and physical properties of the particular explosive that is used in a detonator device.

Turning now to an important aspect of the present invention, and referring to the impactor disc 38, it should be made from a material having physical characteristics that would enable the central portion 38*a* thereof to be sheared from the outer annular portion supported by the annular shoulder 40 and be accelerated through the bore so that is can attain an impact velocity of at least about 1 millimeter per microsecond. It should be understood that the length of the bore 36 through which the pressure accelerates the central portion 38*a* is an important parameter in providing the velocity that is necessary to achieve detonation upon impact with the secondary explosive 46. With the pressure about 50,000 psi generated by the deflagration of the donor explosive within the chamber 14, a flyer or impactor disc having a thickness of about 0.050 inches and a ratio of the thickness to the central portion diameter within the range of about one-half to two-thirds, detonation of the acceptor secondary explosive has been reliably reproduced, when the length of the bore 36 is within the range of about 0.160 to about 0.425 inches. The material used for the flyer disc 38 must be capable of being sheared with the available pressures generated by the donor explosive and be accelerated through the bore so that it impacts with the acceptor secondary explosive at a velocity of at least one millimeter per microsecond. It is also important that the central portion 38*a* be capable of maintaining its structural integrity, i.e., it does not disintegrate into small fragments. The preferred material for the impactor disc 38 is type 6061-T6 aluminum alloy, although other materials having mechanical properties similar to the above may be used. In this connection, aluminum alloy 5052-H38 may also be used, if desired, inasmuch as it has generally similar mechanical properties. The mechanical, tensile, and other physical properties for aluminum alloys are listed in the first edition of Aluminum Standards and Data, April, 1968, published by the Aluminum Association, New York, N.Y. More specifically, the 6061-T6 aluminum alloy has a composition of about 0.4 to 0.8% silicon, about 0.7% iron, about 0.15 to about 0.40% copper, about 0.15% manganese, about 0.8 to about 1.2% magnesium, about 0.04 to about 0.35% chromium, about 0.25% zinc, about 0.15% titanium and the remainder aluminum. The 6061-T6 aluminum alloy has a strength of about 45 ksi, a Brinell hardness number of about 95, an ultimate shearing strength of about 30 ksi, a modulus of elasticity of about 10 ksi and a density of about 169 pounds per cubic foot.

It has been found that if the central portion or flyer disc 38*a* is sufficiently thin, it will tumble or turn during its travel down the bore. Such tumbling is undesirable as it permits pressure to escape between the bore wall and the disc 38*a* and therefore produces generally lower impact velocities, depending upon the amount of pressure loss that is experienced. By utilizing a ratio of thickness to diameter within the prescribed range, the tendency for tumbling or turning of the central portion 38*a* during its travel through the bore is minimized. It has been found that the central portion 38*a* moves through the bore in a manner quite similar to that of the piston within a cylinder. Thus, the thickness to diameter ratio for the center portion 38*a* substantially prevents tumbling and thereby limits blowby and subsequent velocity loss and maximizes the reliability of the device. Moreover, if the impactor disc 38*a* is intact, rather than in a number of fragments when it strikes the acceptor secondary explosive 48, release waves cannot be produced as quickly and the pressure within the explosive produced by the impact is therefore sustained over a longer period of time, which also contributes to more reliable detonation.

The time required for the device to detonate is a function of the current applied to the conductors 20 and 22. Using the preferred types of explosives and the preferred dimensions for the bridge wire 24, it has been found that the device can be set off within 200 to 400 microseconds using a 10 ampere current; 800 to 900 microseconds using a 5 ampere current and somewhat longer than 10 milliseconds using a one ampere current. Thus, high currents produce faster function times and may enable the device to be actuated using a practical capacitor discharge circuit. The device is extremely small and may have an outer diameter of about 0.3 inches, a length of about 0.65 inches and a weight of about 0.2 ounces.

While the device shown in FIG. 1 is provided with an acceptor secondary explosive 48 that is contained within the housing 46, it should be understood that the housing 46 may be removed from the barrel portion 34 in the event a main charge is not desired for a particular use. While such a main charge may be required for detonating high explosives or the like, other uses such as releasing pressurized fluids by bursting diaphragms, actuating mechanical triggers, switches or other impact driven mechanisms may not require an acceptor explosive, and the accelerating central portion 38*a* of the impactor disc 38 may be sufficient to actuate such devices. Such applications may include bursting diaphragms for pressurized fluid containers that are used to fill safety air bags installed in motor vehicles or triggering ejection seats in military aircraft and the like.

While the present invention is susceptible to various modifications and alternative constructions, certain preferred embodiments are shown and described herein. It should be understood however, that it is not intended to limit the invention to the specific forms exposed. On the contrary, it is intended that all substitutions, equivalents and modifications be covered as may be included within the spirit and scope of the present invention as expressed in the appended claims.

Various features of the invention are set forth in the following claims.

We claim:

1. A low voltage hot wire detonator device containing all secondary type explosive and comprising:

a body having a closed end and an internal chamber containing a donor secondary explosive therein, said body having internal threads in the open end opposite said closed end;

hot wire means including electrical conductors extending outwardly through an aperture in said body, said hot wire means being adjacent said donor explosive and adapted to cause ignition thereof in response to a low voltage current being applied to said conductor;

an impactor disc positioned within the chamber of said body adjacent said donor explosive so as to generally cover the same;

barrel means having external threads for engaging the internal threads of said body, said barrel means having an elongated bore defining an air gap and a generally flat annular shoulder for contacting said impactor disc, rotation of said barrel means in a first direction relative to said body causing said barrel means to be moved toward said closed end and bring said impactor disc into contact with said donor explosive so as to tightly confine the same;

the central portion of said impactor disc inside of said annular shoulder being sheared therefrom in response to deflagration of said donor explosive;

said impactor disc being of a thickness and material so that the ratio of the thickness of said sheared central portion to the outer diameter of the sheared central portion is within the range of about ½ to about ⅔, said sheared central portion being accelerated down said bore as a unitary piece, said ratio thereof substantially preventing tumbling of the sheared central portion during travel, thereby preventing substantial escape of explosive gases between said central portion and the wall of said bore.

2. A detonator device as defined in claim 1 wherein said donor secondary explosive is self-sustaining after initial ignition and develops gaseous pressure of about 50,000 psi when deflagrated in said confined first bore.

3. A detonator device as defined in claim 2 wherein said donor secondary explosive is RDX explosive, type B, class C, military standard MIL-R-398C.

4. A detonator device as defined in claim 3 wherein said RDX explosive has a particle size of about 100 microns and a density within the range of about 1.65 to about 1.67 grams per cubic centimeter.

5. A detonator device as defined in claim 1 wherein said acceptor secondary explosive is a PBXN-5 explosive, made in accordance with military standard MIL-E-8111.

6. A detonator device as defined in claim 1 wherein said electrical means comprises an exposed wire bridging the ends of two conductors located within said first bore, said conductors extending to the exterior of said device through one or more apertures located in said closed end, the application of electrical current to said conductors being adapted to heat said exposed wire and ignite said donor secondary explosive in said first bore.

7. A low voltage hot wire detonator device containing all secondary type explosive and comprising:

a body having one closed end and an internal chamber containing a donor secondary explosive therein;

hot wire means including electrical conductors extending outwardly through an aperture in said body, said hot wire means being adjacent said donor explosive and adapted to cause ignition thereof in response to a low voltage current being applied to said conductors;

an impactor disc positioned adjacent said donor explosive in said chamber opposite said closed end;

barrel means in cooperative relation with said chamber in said body and having an elongated bore defining an air gap, said barrel means having a generally flat annular shoulder facing said chamber, said barrel means being adjustable in said chamber to tighten said disc against said donor explosive to tightly confine the same;

an acceptor secondary explosive positioned on the opposite end of said air gap and adapted to be detonated in response to a high velocity impact shock;

said central portion being sheared from said impactor disc in response to deflagration of said donor explosive, the central portion striking said secondary explosive at sufficient velocity to detonate said acceptor explosive;

said impactor disc being of a thickness and material that results in the interior central portion being sheared and accelerated down said bore as a unitary piece, the thickness substantially preventing tumbling of the central portion during travel to prevent substantial escape of explosive gases between said central portion and the wall of said bore.

8. A detonator device as defined in claim 7 wherein said barrel means is removably secured to said body by means of cooperating threads located on both said barrel means and said body.

9. A detonator device as defined in claim 7 wherein said impactor disc has a thickness that is about ½ to about ⅔ the diameter of the central portion and is made from a material that results in said central portion being sheared when subjected to a pressure of about 50,000 psi.

10. A detonator device as defined in claim 7 wherein said hot wire means comprises a bare wire having a diameter of about 0.0015 inches and attached to each of said conductors so that application of electrical current thereto causes said bore wire to heat and ignite said donor secondary explosive.

11. A detonator device as defined in claim 7 wherein said donor secondary explosive is RDX explosive, type B, class C, military standard MIL-R-398C.

12. A detonator device as defined in claim 7 wherein said acceptor secondary explosive is a PBXN-5 explosive made in accordance with military standard MIL-E-8111.

13. A detonator device as defined in claim 9 wherein the composition of said disc is an aluminum alloy having a composition of about 0.4 to 0.8% silicon, about 0.7% iron, about 0.15 to about 0.40% copper, about 0.15% manganese, about 0.8 to about 1.2% magnesium, about 0.04 to about 0.35% chromium, about 0.25% zinc, about 0.15% titanium and the remainder aluminum.

14. A detonator device as defined in claim 7 wherein an electrical current with the range of about 1 to about 10 amperes is sufficient to ignite said donor explosive.

* * * * *